US005624270A

United States Patent [19]

Blanchot et al.

[11] Patent Number: 5,624,270

[45] Date of Patent: Apr. 29, 1997

[54] SAFETY AND/OR POLARIZING DEVICES OF ELECTRIC-POWER CONNECTORS

[75] Inventors: Michele Blanchot, Cravent; Yves Palisson, Huisseau sur Mauves, both of France

[73] Assignee: Professional General Electronic Products P.G.E.P., Courbevoie, France

[21] Appl. No.: 643,398

[22] Filed: May 6, 1996

Related U.S. Application Data

[63] Continuation of Ser. No. 312,868, Sep. 27, 1994.

[30] Foreign Application Priority Data

Sep. 29, 1993 [FR] France ..... 93 11556

[51] Int. Cl.[6] ..... H01R 13/453

[52] U.S. Cl. ..... 439/136; 439/139; 439/143

[58] Field of Search ..... 439/136, 137, 439/139, 138, 143, 145

[56] References Cited

U.S. PATENT DOCUMENTS

| | | | |
|---|---|---|---|
| 2,740,943 | 4/1956 | Young | 439/145 |
| 4,494,809 | 1/1985 | Soloman | 439/369 |
| 4,640,564 | 2/1987 | Hill | 439/137 |
| 5,281,156 | 1/1994 | Yi | 439/145 |

FOREIGN PATENT DOCUMENTS

| | | | |
|---|---|---|---|
| 539093 | 10/1992 | European Pat. Off. . | |
| 2271680 | 5/1974 | France . | |
| 2584873 | 11/1985 | France . | |
| 2584873 | 1/1987 | France | 439/137 |
| 2109720 | 10/1971 | Germany | 439/139 |
| 9211368 | 5/1992 | Germany . | |
| 67675 | 5/1973 | Luxembourg . | |
| 534702 | 3/1941 | United Kingdom | 439/137 |
| 612486 | 5/1946 | United Kingdom . | |
| 682727 | 8/1950 | United Kingdom . | |
| 763001 | 4/1954 | United Kingdom . | |
| 2260863 | 10/1991 | United Kingdom . | |

*Primary Examiner*—David L. Pirlot
*Assistant Examiner*—T. C. Patel
*Attorney, Agent, or Firm*—Lowe, Price, LeBlanc & Becker

[57] ABSTRACT

An electric-power connector consists of a plug (1) and a female element, i.e. a socket (2), said socket (2) bearing the grounding pin if any and comprising a mask (3) moved by a return means into its closed position in front of said socket's orifices (40, 20) in order to render said socket inoperative by sealing its orifices, the socket's orifices becoming operative again when the mask shall be moved by an actuating means mounted on the plug (1), said mask (3) being kept in its closed position by a lock (6). Said lock (6) consists of elements which are distinct from the mask (3), and where called for the plug (1) is fitted with an inserted unlocking control means (7) which, when mounted on said plug, drives the lock (6) of the mask (3), the driving of the mask (3) being determined by the means mounted on the plug.

12 Claims, 4 Drawing Sheets

SAFETY AND/OR POLARIZING DEVICES OF ELECTRIC-POWER CONNECTORS

This application is a continuation of application Ser. No. 08/312,868 filed Sep. 27, 1994.

The present invention concerns a safety and/or polarizing device for electric-power connectors.

FIELD OF THE INVENTION

An electric-power connector consists of a female element called "socket" comprising one or more orifices with electrical contacts and of a male element called "plug" comprising one or more pins to enter the socket orifices. When the socket is affixed to a wall or a bus, it is frequently called "outlet".

BACKGROUND ART

As regards household appliances fed for instance with 110 or 220 volts, the plugs and sockets comprise two power conductors which as a rule are accompanied by a grounding wire. When the system includes such a grounding wire, it will be mounted on the socket and the orifice set aside for the plug in order to prevent any handling mistakes.

It was found early that the sockets may be dangerous to children who may insert metal objects (nails, screws, needles etc) into their orifices and thus may be electrocuted.

Accordingly it has already been suggested to mount protecting means on the sockets to render the orifice inoperative, said protective means being bypassed by the plug pins or by an additional control pin when the plug is inserted into the socket. Such devices fill two purposes: on one hand they safeguard the children from accidents and on the other hand they allow discriminating between appliances that can be hooked into a socket so fitted and those that must not be because only specific plugs comprise means to deactivate the orifice protecting means.

Illustratively, a household or shop may be equipped with electric power for all household appliances and various tools and further with special, ie "dedicated" electric power for sensitive equipment such as computers.

The French utility certificate 2,271,680 (Couqueberg) of 14 May 1974 discloses an electric-power connector comprising on one hand a socket with a mask sealing the socket orifices and thus making them inoperative, and on the other hand a plug which in addition to the two power pins also comprises an additional pin fitted with means to make the mask pivot to render the orifices accessible to the pins. This connector operates both as a safety and as a discrimination, i.e. a polarizing means, however a child still is able to rotate the mask.

The U.S. Pat. No. 4,494,809 (Soloman) of 22 Jan. 1985 combines the plug with an adapter controlling the insertion of a plug into a socket. This device allows discriminating between equipment to be hooked up, and that which must not be, to a given power source, but on the other hand it fails to provide safety to children.

As regards the system marketed by applicant as SECURIPRISE in 1982 and 1983, the means rendering the socket orifices inoperative are two contact pawls which will elastically retract from the orifices when in the inactive position and which are advanced into the active position by thrust means resting on the plug. These pawls are connected to the electric power source whereas the orifices are fitted conventionally with current conductors. By interrupting the electric power in their inactive position, said pawls thus inactivate the socket's orifices.

Similarly to the case for the Couqueberg document 2,271,680, the advantage of such a connector is that, with the thrust means resting on a fitting adaptable to the plug, the user was free to make use of it or to disregard it.

However it has been found that the safety function of such a connector is inadequate because a child might insert a curved metal object simultaneously into the two orifices and thus receive an electric shock. Furthermore this kind of connector does not meet present safety codes.

According to present safety codes, such a connector not only must provide that the two orifices be closed, i.e. inactive, when the plug has been withdrawn, but also the protection offered by the safety device must be preserved when an object is inserted into one of the two orifices.

The Luxembourg patent 67,675 (Niko P.V.B.A.) of 26 Jul. 1973 discloses a socket with a cover some distance from its front surface evincing orifices which are axially aligned with those of said front surface, the latter being linked to the power wires. A rotating mask is present between said cover and said front surface and comprises two flexible arms which are present between the socket's corresponding orifices and which are fitted with studs that may lock into one of the orifices of the front surface of the socket when the two arms are NOT jointly driven by the two plug pins. Such a connector meets the safety code but does not allow discriminating between two power sources.

Applicant moreover marketed a mask comprising two flexible arms fitted with studs and similar to the above described mask but sliding within the connector and elastically returning into the closed position between the matching orifices of said socket.

Again British electric power sources are known comprising masks fitted to be kept in their closed positions. Such systems are based on the principle that in British power sources, the grounding pin if any is borne by the plug and is longer than the pins connected to the electric conductors. As a result they cannot be adapted to those devices wherein the grounding pin is borne by the socket.

SUMMARY OF THE INVENTION

The object of the present invention is an electric-power connector consisting of a male and a female component, i.e. of a plug and socket resp., either bearing the grounding pin if any, said connector comprising locks for the masks for the socket orifices.

Such a connector advantageously offers the desired dual function of safety and discrimination, ie polarization.

BRIEF DESCRIPTION OF THE DRAWINGS

The invention is elucidated in the description below of an illustrative and non-limiting embodiment and in relation to the attached drawings.

DESCRIPTION OF THE PREFERRED EMBODIMENTS

Figure 1:
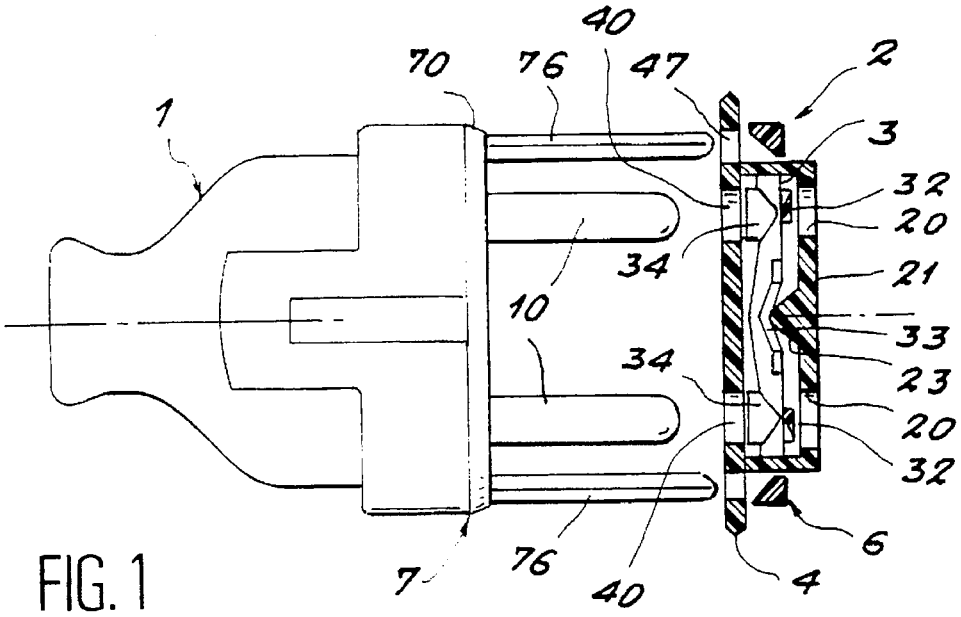
FIG. 1 is a partial section of an electric-power connector of the invention.

The electric-power connector shown in FIG. 1 comprises the conventional male component, i.e. the plug 1, and the conventional female component, i.e. the socket 2.

The plug comprises two pins 10 which will be moved into orifices 20 of the socket, omitted electric power conductors being connected to said pins.

In conventional manner and omitted from the drawings, the plug may comprise an orifice receiving a grounding wire borne by the socket.

The socket 2 is configured so that it may house a mask 3.

For that purpose a lid 4 is mounted a distance from the pin front pane 21. Two orifices 40 pass through this lid 4 and are aligned with the orifices 20 of the front pane 21, said lid also being configured to be crossed by a grounding pin if so provided.

The mask 3 is located between said orifices 40 of the lid 4 and orifices 20 of the front pane 21 so as to control the passing of plug pins 10 in the direction of said orifices 20.

In the embodiment shown by the drawings, the mask 3 consists of a base 30 and of two arms 31 and as a whole assumes the shape of a T.

The base 30 of said mask comprises a semi-cylindrical cutout 37 substantially matching the cutout 27 of the front pane 21 to pass an omitted grounding pin.

The arms 31 comprises bosses 34 on one of their sides and studs 32 on their other sides. These bosses 34 and studs 32 are arranged to match one another.

Said bosses and studs are arrayed in such manner on the arms 31 that they are aligned with the orifices 40 and 20 when the mask 3 is housed between the front pane 21 and the lid of the socket 21. The bosses 34 are opposite the orifices 40 of the lid 4 whereas the studs 32 are opposite the orifices 20 of the front pane 21.

FIGS. 2 through 6 show the socket with the lid removed to simplify the drawings.

The socket's front pane 21 comprises a cross-sectionally triangular rib 23 whereas the base 30 of the mask 3 comprises also a cross-sectionally triangular groove 33, the vertex angle of the groove 33 being larger than that of the rib 23.

The mask 3 is mounted in pivoting manner on the front pane 21 by positioning the groove 33 on the rib 23. That side of the mask 3 which lacks the groove 33 assumes a dihedral shape, whereby said mask can pivot when inside the housing formed by the front pane 21 and the lid 4.

The mask 3 is subjected to a return means which moves it back into its so-called closed position wherein it seals off the socket orifices 20.

In the embodiment mode shown in the drawing, this return means is a spring 5 located between a collar 25 of the front pane 21 and an end-piece 35 on said spring.

Figure 2:
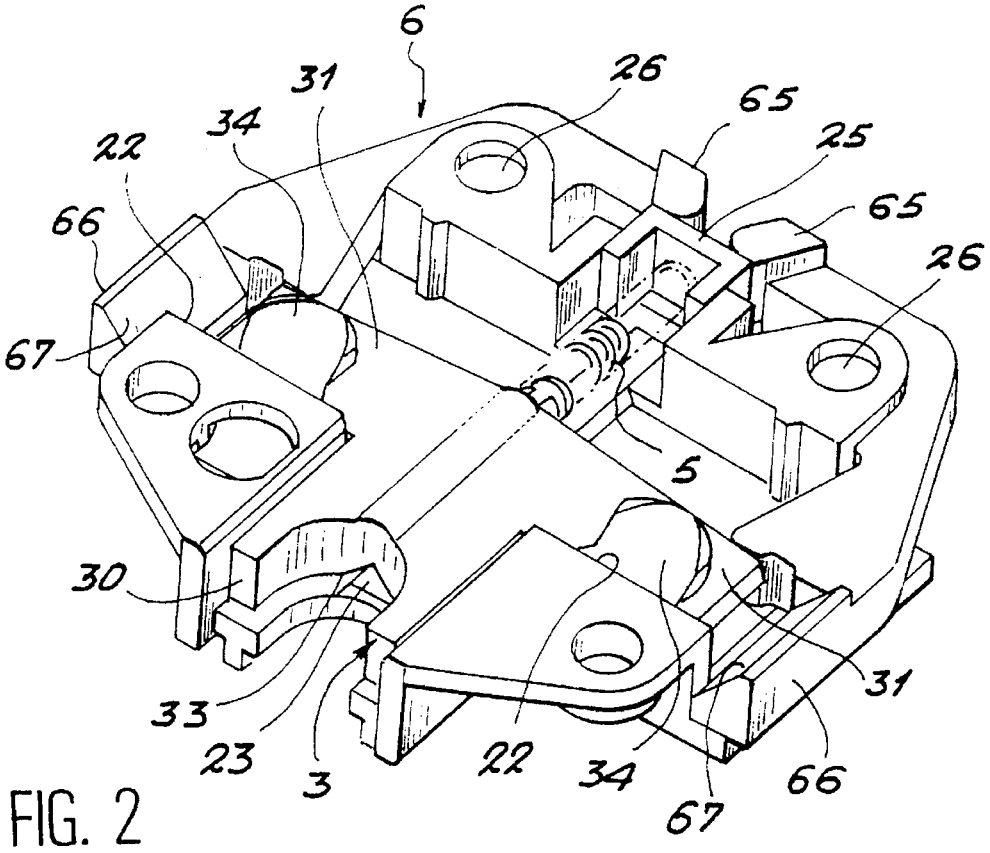
FIG. 2 is a perspective with cutaway of the socket in the locked position of the mask.
Figure 3:
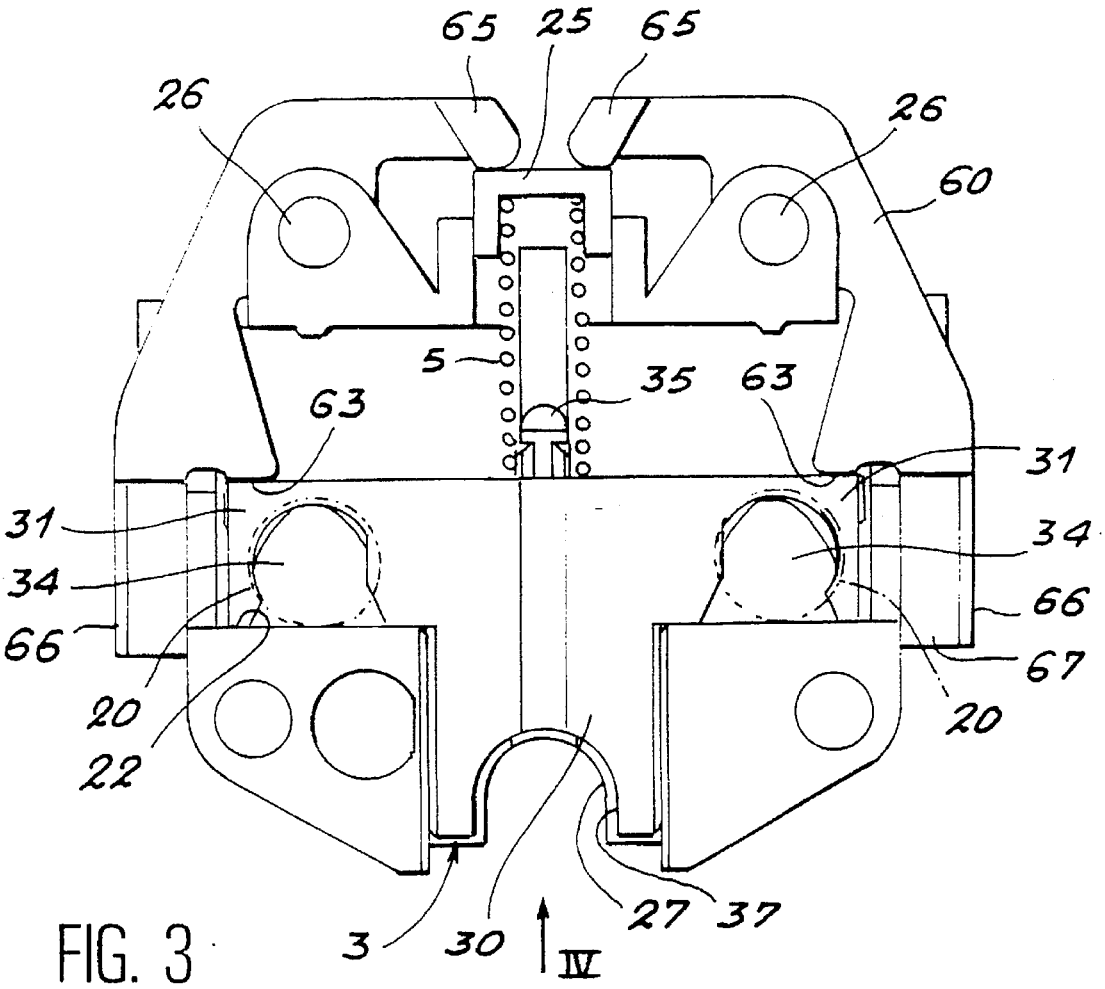
FIG. 3 is a topview of the socket in the locked mask position.

This spring 5 elastically returns said mask 3 to the position it assumes in FIGS. 2 and 3 wherein its arms 31 rest against stop sides 22 of the socket and wherein they are located above the orifices 20 of the front pane 21.

In this closed position, the mask is located between the orifices 40 and 20 of the lid 4 and the socket front pane 21 and it blocks access to said orifices 20 which are connected to the electric power.

The spring 5 may be replaced by any other return means. Illustratively, magnetic means may be used. Such means may be repulsive and might be located between the mask 3 and that part of the socket which is present around the collar 25, or they may be attractive and be located between said mask 3 and the stop sides 22.

In such designs the mask then can only be moved from this closed position by a means mounted on the plug. In the present instance, such a means is constituted by the plug pins.

The mask 3 is pushed back by the symmetrical and simultaneous action of the plug pins 10.

For that purpose the bosses 34 each comprise an upper side sloping in the direction of the stop sides 22, the height of said bosses then being least where nearest said stop sides 22.

Figure 5:
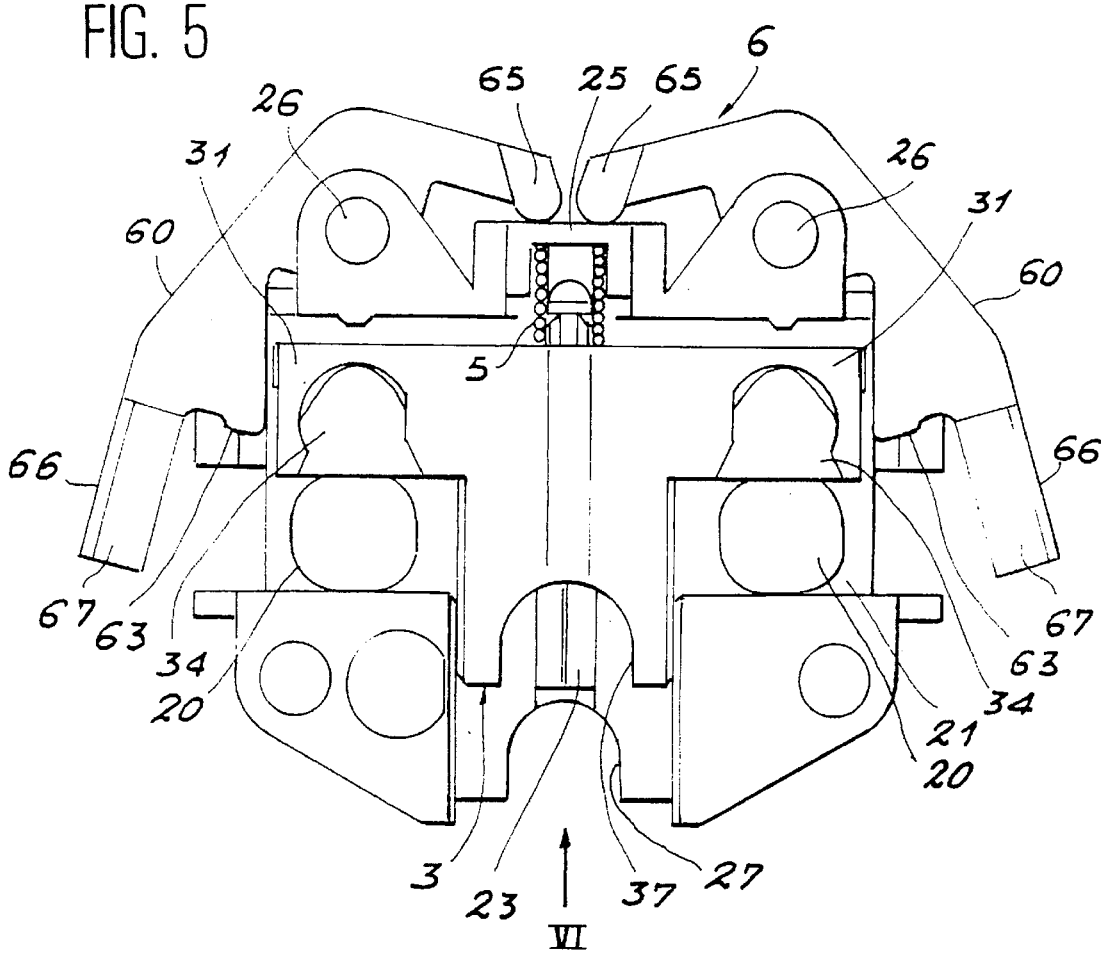
FIG. 5 is a view similar to FIG. 3 but for the unlocked mask position.
Figure 6:
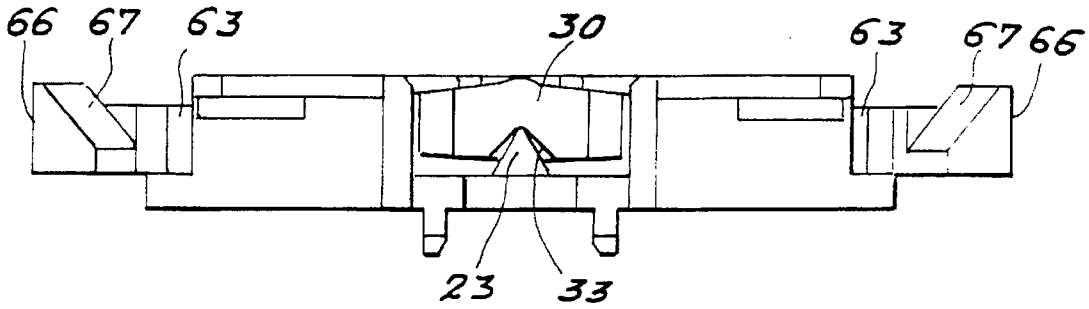
FIG. 6 is a view along arrow VI of FIG. 5.

When plug pins 10 are inserted into the lid orifices 40 to make electrical connection, the ends of said pins 10 make contact with the sloping sides of said bosses 34, whereby the mask 3 is forced against the action of spring 5 into its open position shown in FIG. 5, said mask thus clearing the orifices 20 and allowing insertion of said pins.

If the plug is inserted in somewhat asymmetrical manner or if an object other than a plug is inserted into the socket orifices, the mask 3 will pivot about the rib 23, whereby one of the studs 32 will enter an orifice 20 and prevent said mask 3 from being withdrawn in the direction of its open position.

The connector described so far ensures user safety and meets present-day codes. Within the scope of the invention, this connector furthermore is modified to also allow discrimination between different electric power sources.

For that purpose the invention adds locks locking said mask to this connector. These locks consist of components distinct from said mask and serve to keep this mask in its closed position wherein it seals off the socket orifices.

This lock comprises two arms 60 mounted on the socket front pane 21. Said arms may be rotating by being mounted on stubs 26 of the front pane 21, or they may bear arbor segments located in boreholes of said front pane.

Said arms 60 comprise ends 65 and 66 which in the embodiment shown are mutually orthogonal.

The ends 66 are located opposite the mask 3 and comprise a surface 67 sloping in such manner toward the orifices 20 of the front pane 21 that a force applied vertically from top to bottom on this sloping surface 67 shall move said ends 66 away from said orifices 20.

A distance away from the end zones of the ends 66, the arms 60 comprise heels 63 on the inside of said arms and perpendicular to said ends 66, said studs being opposite the arms 31 of the mask 3.

A return means moves said arms 60 in that direction which brings their ends 66 nearer to the orifices of the front panel 21.

In the embodiment mode shown in FIGS. 2, 3 and 5, this return means is elastic and consists of a spring 5 which repels the mask 3 into its closed position. For that purpose the collar 25 receiving one end of the spring 5 slides on the plug front panel 21 and the ends 65 of the arms 60 rest against the socket outside.

When the socket is free of any force, said spring 5 repels the mask 3 into its closed position and the arms 60 into the position wherein they lock said mask 3.

Figure 7:
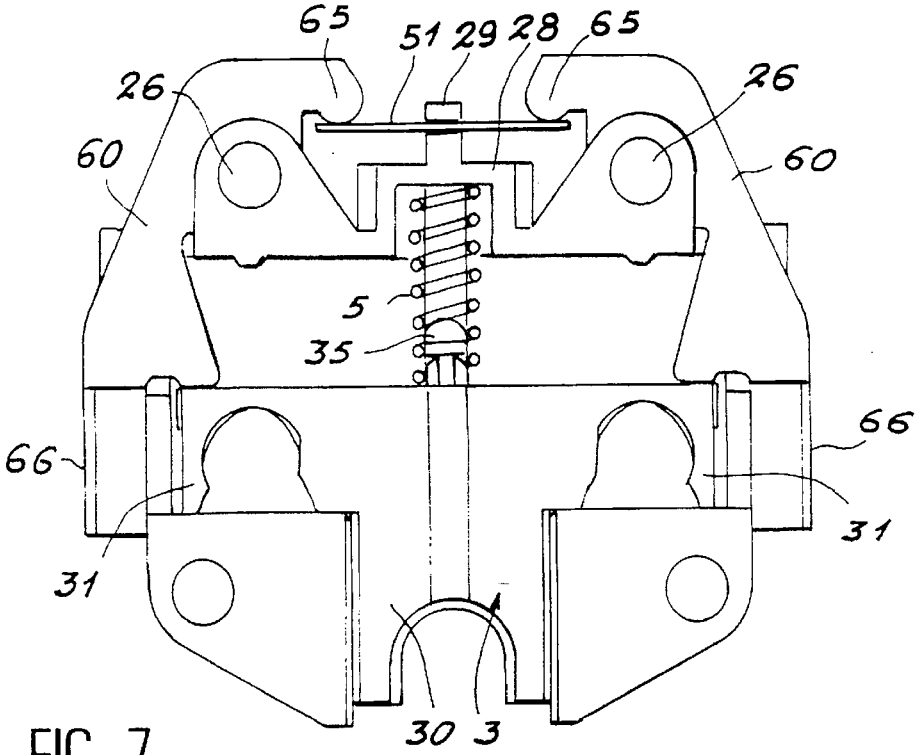
FIG. 7 is a view for the socket in the locked position for a second embodiment mode of the invention.
Figure 8:
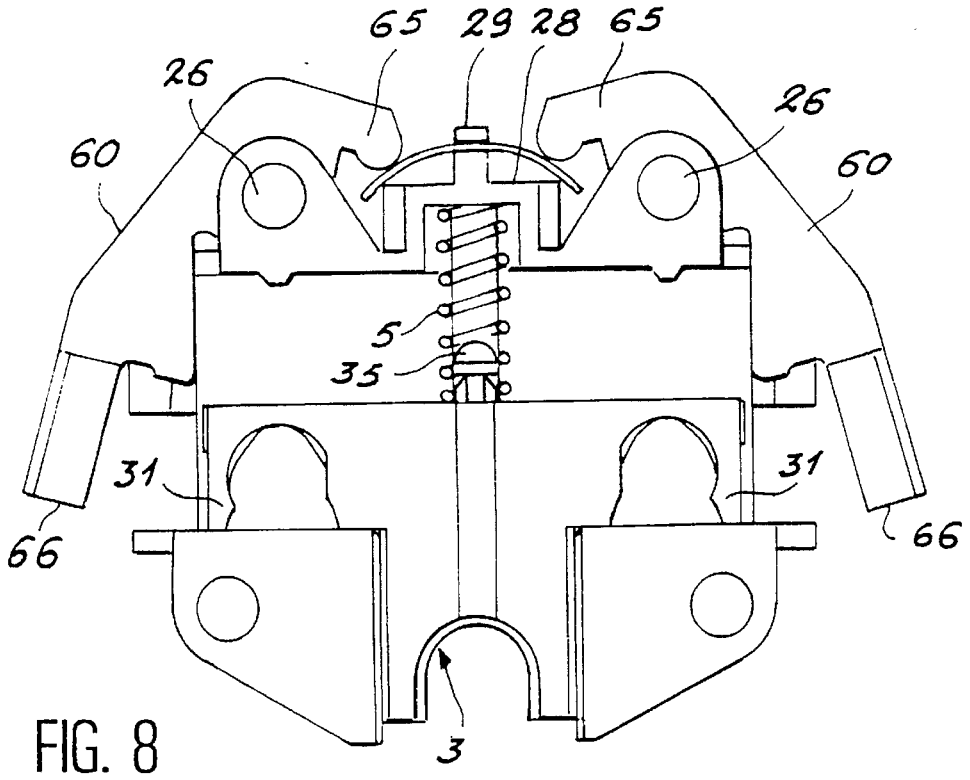
FIG. 8 is a view of the connector of FIG. 7 with the lock unlocked.

In an embodiment variation such as shown by FIGS. 7 and 8, the return means may be different from the one returning the mask into its closed position.

In this embodiment variation, the sliding collar 25 is replaced by a stationary collar 28 which on its side facing the arm ends 65 bears a stub 29 onto which is affixed a flexible blade 51. Said flexible blade rests against the ends 65 of the arms 60 and repels them in the locking direction of the lock.

Obviously other devices may be used for the return means locking the arms 60.

Illustratively elastic means may be mounted around the stubs 26 or magnetic means may be used which when attractive are mounted opposite the arm ends 66 or when repulsive are mounted opposite the ends 65 of these arms 60.

Figure 4:
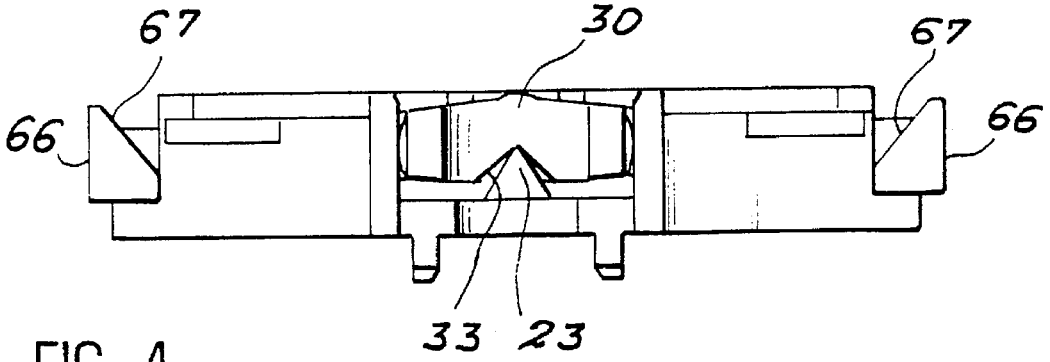
FIG. 4 is a view along the arrow IV of FIG. 3.

As regards the locking position shown in FIGS. 2 through 4, the heels 63 are arrayed opposite the mask arms 31 to prevent this mask from moving in the direction that would clear the orifices 20. In this case the mask 3 is retained between the heels 63 of the locking arms 60 and the stop sides 22 of the front pane 21.

If the attempt is made to insert a conventional plug 1 into the socket 2 of which the mask 3 is locked in the above manner, the mask will not move out of the way to provide access to the orifices 20 even though the pins 10 properly press against the bosses 34.

Only plugs fitted with a control device 7 can be inserted into the socket of the invention.

As shown by FIG. 1, the control device 7 consists of a disk 70 bearing two pegs 76, said disk being so mounted on the plug that it is inserted between said plug and socket when connection is made. This control means may be mounted on the plug following fabrication and be affixed by any suitable means such as bonding or screwing onto the plugs of appliances that shall be accessible to, ie polarized for, the socket fitted with the locks. In a variation this control means may be manufactured from the plugs which inherently comprise said pegs 76.

The pegs 76 are diametrically opposite and are located each outside resp. the pins 10. The distance between said pegs equals that between the ends 66 of the arms 60 when latter are locked.

As the plug nears, said pegs make contact with the sloping surfaces 67 and move apart the ends 66 of the arms 60 against the force of the spring 5. The pegs being present between the front pane 21 and the arms 60 prevent said arms from elastically returning into their locked position and thereupon the mask 3 can be forced back by the pins 10 acting on the bosses 34.

The lid 4 comprises apertures 47 to guide said pegs 76 while the plug is nearing.

It is clear furthermore that formal modifications may be introduced, using many kinds of masks, whether the latter be moved out of the way by translation or rotation, by simultaneous action of the plug pins or by any other means borne on said plug, said mask moreover possibly being directly mounted on or be separate from the above described unlocking control 7.

We claim:

1. An electric-power connector consisting of a plug and a socket, said socket further comprising a mask moved by a return means back into a closed position in front of orifices of said socket in order to render said socket inoperative by blocking said orifices, the socket orifices becoming operative again when the said mask is driven by an actuating means on the plug, said mask being kept in its closed position by a lock, characterized in that said lock is constituted by elements distinct from the mask, the plug being fitted with an unlocking control-means which drives the lock of the mask, actuation of said mask being determined by the actuating means affixed to the plug, said unlocking control-means being separate from said actuating means.

2. Connector defined in claim 1, characterized in that said lock comprises two arms mounted on the socket.

3. Connector defined in claim 2, characterized in that said arms are rotary on the socket.

4. Connector defined in claim 2, characterized in that said arms comprise ends located opposite the mask.

5. Connector defined in claim 3, characterized in that said ends each comprise a surface sloping in such manner toward the socket orifices that a force applied vertically from top to bottom on this sloping surface will move said ends away from said orifices.

6. Connector defined in claim 2, characterized in that the arms comprise heels which, in the locked position, are located opposite the mask in order to prevent the mask from moving in such a way as to clear the orifices (40, 20).

7. Connector defined in claim 2, characterized in that a return means moves said arms into their locked position.

8. An electric-power connector consisting of a plug and a socket, said socket further comprising a mask moved by a return means back into a closed position in front of orifices of said socket in order to render said socket inoperative by blocking said orifices, the socket orifices becoming operative again when the said mask is driven by an actuating means on the plug, said mask being kept in its closed position by a lock, characterized in that said lock is constituted by elements distinct from the mask, the plug being fitted with an unlocking control-means which drives the lock of the mask, actuation of said mask being determined by the actuating means affixed to the plug, said unlocking control-means being separate from said actuating means further characterized in that the unlocking control-means consists of a disk bearing two pegs, said disk being mounted in such manner on the plug that the disk will be inserted between the socket and the plug when connection is made.

9. Connector defined in claim 8, characterized in that the pegs are located on either side of pins of the plug and are apart by a distance which is equal to the distance between the ends of the arms when in their locked position in such manner that said pegs will make contact with the sloping surfaces when the plug is nearing and will move away the ends of the arms against the force of the return means in order to free the mask.

10. Connector defined in claim 7, characterized in that the lock return-means when in the locked position moves the mask back into its closed position.

11. Connector defined in claim 10, characterized in that said return means is a spring present by one of its ends in a collar sliding on the socket, the ends of the arms of the lock resting against the outside of said collar.

12. Connector defined in claim 10, characterized in that said return means is a flexible blade resting against the ends of the arms.

* * * * *